US008863985B2

(12) United States Patent
Berge et al.

(10) Patent No.: US 8,863,985 B2
(45) Date of Patent: Oct. 21, 2014

(54) METHOD AND APPARATUS FOR VOLUMETRICALLY SUPPLYING ICE TO ICE OUTPUT SYSTEMS

(75) Inventors: J. Eric Berge, Irvine, CA (US); Brandon D. Berge, Costa Mesa, CA (US); Mark A. McClure, Chino Hills, CA (US); Glenn S. Seamark, Lake Forest, CA (US)

(73) Assignee: Ice Link, LLC, Orange, CA (US)

( * ) Notice: Subject to any disclaimer, the term of this patent is extended or adjusted under 35 U.S.C. 154(b) by 893 days.

(21) Appl. No.: 12/803,997

(22) Filed: Jul. 12, 2010

(65) Prior Publication Data

US 2012/0006846 A1 Jan. 12, 2012

(51) Int. Cl.

| | |
|---|---|
| ***B67D 7/30*** | (2010.01) |
| ***B67D 3/00*** | (2006.01) |
| ***B67D 7/08*** | (2010.01) |
| ***F25C 1/00*** | (2006.01) |
| ***F25C 5/00*** | (2006.01) |

(52) U.S. Cl.

CPC ..... *F25C 5/002* (2013.01)

USPC ..... 222/14; 222/639; 222/504; 222/65; 222/447; 222/1; 62/137

(58) Field of Classification Search

USPC ..... 222/56, 64, 434, 438, 146.6, 144.5, 14, 222/21, 639, 638, 640, 641, 642, 504, 450, 222/505, 65, 447, 445; 62/135, 137; 193/34

See application file for complete search history.

(56) References Cited

U.S. PATENT DOCUMENTS

| | | | | |
|---|---|---|---|---|
| 1,084,909 | A * | 1/1914 | Stepanian | 222/447 |
| 2,366,343 | A * | 1/1945 | Ludwig | 222/230 |
| 2,723,057 | A * | 11/1955 | Golden | 222/442 |
| 3,542,255 | A * | 11/1970 | Oetiker | 222/445 |
| 3,640,089 | A * | 2/1972 | Frazier | 62/320 |
| 4,227,383 | A * | 10/1980 | Horvay | 62/344 |
| 4,386,640 | A * | 6/1983 | Carr et al. | 141/361 |
| 4,921,149 | A * | 5/1990 | Miller et al. | 222/639 |
| 5,501,367 | A * | 3/1996 | Chigira | 222/55 |
| 5,542,583 | A * | 8/1996 | Boyer et al. | 222/425 |
| 5,967,366 | A * | 10/1999 | Cason | 222/2 |
| 6,093,312 | A * | 7/2000 | Boulter | 210/86 |
| 6,442,954 | B1 * | 9/2002 | Shapiro et al. | 62/137 |
| 6,607,096 | B2 * | 8/2003 | Glass et al. | 222/1 |
| 6,827,529 | B1 * | 12/2004 | Berge et al. | 406/28 |
| 7,392,665 | B2 * | 7/2008 | Lee et al. | 62/353 |
| 7,571,619 | B2 * | 8/2009 | Park et al. | 62/320 |
| 7,770,408 | B2 * | 8/2010 | Kim et al. | 62/344 |
| 7,895,859 | B2 * | 3/2011 | Anselmino et al. | 62/344 |
| 2008/0128458 | A1 * | 6/2008 | Njaastad et al. | 222/639 |

* cited by examiner

*Primary Examiner* — Kevin P Shaver
*Assistant Examiner* — Stephanie E Williams
(74) *Attorney, Agent, or Firm* — Christopher L. Makay

(57) ABSTRACT

An ice supply system includes an ice transport system, a volumetric feeder coupled with the ice transport system and adapted to deliver a preset volume of ice to an ice output system, and an ice delivery controller coupled with the ice transport system, the volumetric feeder, and the ice output system. The ice delivery controller receives ice requests from the ice output system, controls the delivery of ice from the ice transport system to the volumetric feeder in response to ice requests, controls the volumetric feeder to receive the preset volume of ice therein, and controls the delivery of the preset volume of ice from the volumetric feeder to the ice output system.

16 Claims, 6 Drawing Sheets

METHOD AND APPARATUS FOR VOLUMETRICALLY SUPPLYING ICE TO ICE OUTPUT SYSTEMS

BACKGROUND OF THE INVENTION

1. Field of the Invention

The present invention generally relates to dispensing equipment and, more particularly, but not by way of limitation, to a system for generating, transporting, and dispensing ice without exposure to external contaminants.

2. Description of the Related Art

Most convenience and grocery stores sell ice, typically sold in bags. The stores contract with an ice company that delivers individual bags of ice to the stores for its customers. Unfortunately, ice companies are often expensive and less than reliable in supplying bags of ice to any individual store.

In an attempt to reduce dependence upon outside ice companies, automatic ice bagging units have been developed. An ice maker of an automatic ice bagging unit delivers ice into a holding bin. An ice mover within the holding bin moves the ice from the holding bin to a bagging mechanism where the value/weight of the ice is monitored to get the appropriate size/weight of ice in the bag. Once filled the bag is sealed and dropped into a merchandiser. A disadvantage of automatic ice bagging units however is that providing a continuous supply of ice has long been problematic, especially when an automatic ice bagging unit is exposed to large volumes of consumers. The ice maker of any automatic ice bagging unit is of limited size based upon the size constraints of the automatic bagging unit as a whole. As such, the ice maker of any automatic ice bagging unit often cannot produce enough ice to satisfy customer demand. In those situations, stores resort to the manual replenishment of the merchandiser by an attendant from a large-capacity ice making system in another part of the store. This unfortunately exposes the ice to a variety of potentially unfavorable and even unhealthy conditions.

U.S. Pat. No. 6,266,945, which issued Jul. 31, 2001, to Schroeder, addresses the foregoing problem through the connection of an ice supply system with a larger capacity ice maker directly to the holding bin of an automatic ice bagging unit. Unfortunately, automatic ice bagging units are large, complex, and expensive pieces of equipment. In particular, the ice bagging and weighing mechanisms of automatic ice bagging units operate less than satisfactorily in delivering the correct size/weight of ice into a bag. While U.S. Pat. No. 6,266,945 offers a solution to ice supply problems, it does not address how an ice supply system could improve the operation of an automatic ice bagging unit.

Accordingly, a method and apparatus that volumetrically supplies ice to an ice storage system such as an automatic ice bagging unit would improve over prior ice supply systems.

SUMMARY OF THE INVENTION

In accordance with the present invention, an ice supply system includes an ice transport system, a volumetric feeder coupled with the ice transport system and adapted to deliver a preset volume of ice to an ice output system, and an ice delivery controller coupled with the ice transport system, the volumetric feeder, and the ice output system. The volumetric feeder is adjustable to change the preset volume of ice delivered to the ice output system. The ice delivery controller receives ice requests from the ice output system. In a preferred embodiment, the ice delivery controller determines from an ice request a delivery number which is the number of times the volumetric feeder must deliver the preset volume of ice to the ice output system in order to fill the ice request.

The ice delivery controller activates the ice transport system to deliver ice to the volumetric feeder upon the receipt of an ice request. Likewise, the ice delivery controller deactivates the ice transport system once the ice request has been filled. Alternatively, in a preferred embodiment, the ice delivery controller deactivates the ice transport system once a delivery number has been reached.

The ice delivery controller controls the volumetric feeder to receive the preset volume of ice therein by opening an inlet into the volumetric feeder while closing an outlet from the volumetric feeder. Once the ice delivery controller determines the volumetric feeder has received the preset volume of ice from the ice transport system, the ice delivery controller controls the delivery of the preset volume of ice from the volumetric feeder to the ice output system by closing the inlet into the volumetric feeder while opening the outlet from the volumetric feeder. When fulfilling an ice request requires multiple deliveries of the preset volume of ice from the volumetric feeder, the ice delivery controller sequentially opens and closes the inlet into the volumetric feeder and the outlet from the volumetric feeder to receive and deliver the preset volume of ice to the ice output system until a delivery number has been reached.

The volumetric feeder includes an inlet ice transport conduit having an inlet coupled with the ice transport system and an outlet as well as an inlet gate valve disposed in the inlet ice transport conduit. The volumetric feeder further includes a volumetric chamber having an inlet coupled with the outlet of the inlet ice transport conduit and an outlet. A stop disposed in the inlet ice transport conduit prevents the over insertion of the volumetric chamber into the inlet ice transport conduit. The volumetric feeder still further includes an outlet ice transport conduit having an inlet coupled with the outlet of the volumetric chamber and an outlet coupled with the ice output system as well as an outlet gate valve disposed in the outlet ice transport conduit. A sensor disposed in the inlet ice transport conduit and coupled with the ice delivery controller measures the volume of ice in the volumetric feeder and outputs a signal indicating when the volumetric feeder has received the preset volume of ice therein. The position of the outlet ice transport conduit is adjustable relative to the volumetric chamber such that the preset volume of ice delivered to the ice output system is adjustable.

The ice delivery controller controls the volumetric feeder to receive the preset volume of ice therein by opening the inlet gate valve while closing the outlet gate valve. Once the sensor indicates to the ice delivery controller that the volumetric feeder has received the preset volume of ice from the ice transport system, the ice delivery controller controls the delivery of the preset volume of ice from the volumetric feeder to the ice output system by closing the inlet gate valve while opening the outlet gate valve. When fulfilling an ice request requires multiple deliveries of the preset volume of ice from the volumetric feeder, the ice delivery controller sequentially opens and closes the inlet gate valve and the outlet gate valve until a delivery number has been reached.

A method of supplying ice to an ice output system includes providing an ice transport system and a volumetric feeder coupled with the ice transport system and adapted to deliver a preset volume of ice to an ice output system. Upon receipt of an ice request from the ice output system, the ice transport system delivers ice to the volumetric feeder. After receiving the preset volume of ice in the volumetric feeder, the volumetric feeder delivers the preset volume of ice to the ice output system followed by the cessation of the delivery of ice from the ice transport.

A method of supplying ice to an ice output system includes providing an ice transport system and a volumetric feeder coupled with the ice transport system and adapted to deliver a preset volume of ice to an ice output system. Upon receipt of an ice request from the ice output system, a delivery number is determined followed by the delivery of ice from the ice transport system to the volumetric feeder. The preset volume of ice is sequentially received in the volumetric feeder and sequentially delivered from the volumetric feeder to the ice output system until the delivery number has been reached. The delivery of ice from the ice transport system to the volumetric feeder is ceased once the delivery number has been reached.

It is therefore an object of the present invention to provide a volumetrically correct ice supply for transporting and dispensing ice to an ice output system without exposure to external contaminants.

Still other objects, features, and advantages of the present invention will become evident to those skilled in the art in light of the following.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various forms, the figures are not necessarily to scale, and some features may be exaggerated to show details of particular components or steps.

Figure 1A:
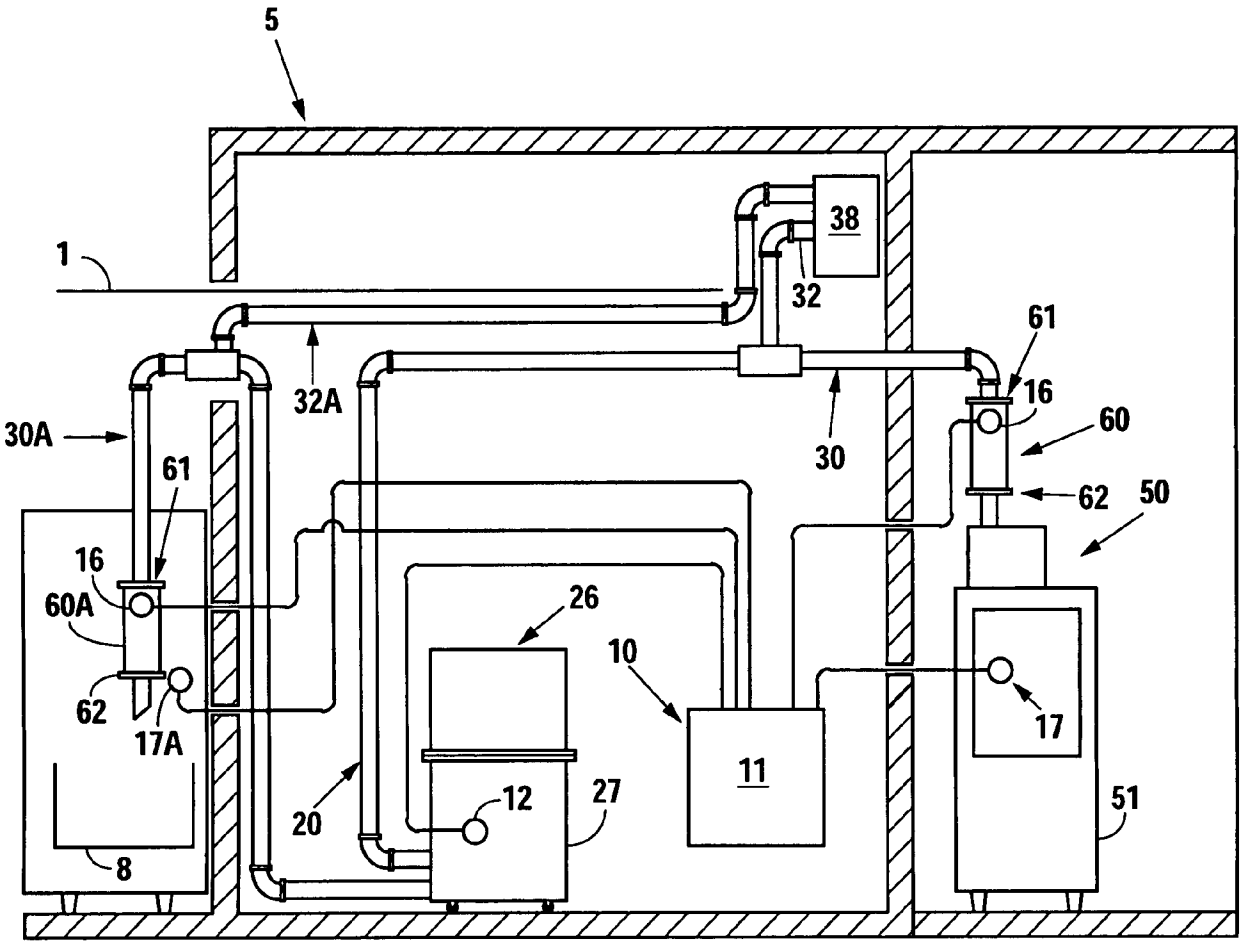
FIG. 1A is a schematic view illustrating an ice supply system according to a preferred embodiment for generating, transporting, and volumetrically metering ice into an ice output system without exposure to external contaminants.

As illustrated in FIG. 1, an ice supply system 1 includes volumetric feeders 60 and 60A and an ice transport system 20 for providing a supply of ice therefrom to the volumetric feeders 60 and 60A. Although those skilled in the art will recognize many suitable means for transporting a supply of ice, the preferred ice transport system 20 comprises an ice transport system disclosed in U.S. Pat. No. 6,827,529 entitled "Vacuum Pneumatic System for Conveyance of Ice" which is assigned to Ice Link, LLC of Orange, Calif. and incorporated herein by reference. As those skilled in the art are aware, other ice transport systems have been patented or are in use in the public domain. Such ice transport systems typically use air or gas that is under pressure to convey ice. Nevertheless, the ice transport system according to the preferred embodiment is the vacuum conveyance type described in U.S. Pat. No. 6,827,529.

Still referring to FIG. 1, the ice transport system 20 includes a dispenser ice bin 27 having an unbridger for delivering ice supplied thereto into the ice conduit systems 30 and 30A, which, in turn, deliver ice to a respective volumetric feeder 60 and 60A. The ice transport system 20 preferably includes an icemaker 26 for generating and supplying ice to the dispenser ice bin 27. The ice transport system 20 further includes a vacuum pump 38 linked with the ice conduit systems 30 and 30A via a respective vacuum line 32 and 32A. Activation of the vacuum pump 38 creates a negative pressure within one of or both of the ice conduit system 30 and 30A resulting in ice traveling from dispenser ice bin 27 to one of or both of the volumetric feeders 60 and 60A. While the ice supply system 1 has been shown as including an ice transport system 20 with the ice conduit systems 30 and 30A feeding the volumetric feeders 60 and 60A, those skilled in the art will recognize that the ice transport system 20 could include only a single an ice conduit system feeding a single volumetric feeder or multiple an ice conduit systems feeding multiple volumetric feeders depending upon the application for the ice supply system 1.

The volumetric feeders 60 and 60A each connect with an ice output system, such as an automatic ice bagging unit; a consumer bin delivery system; a stand alone ice bin; an ice bin of a beverage dispenser; an outlet pipe capable of placement over or in a consumer bin, an ice chest, an ice storage container, or the like, with the outlet pipe including a tube coming down or even through wall; or any suitable means for receiving, storing, and/or outputting ice. The delivery of ice from the volumetric feeders 60 and 60A may be activated manually or by money, token, or credit card, or remotely activated such as an air pump at a gas station.

Figure 1B:
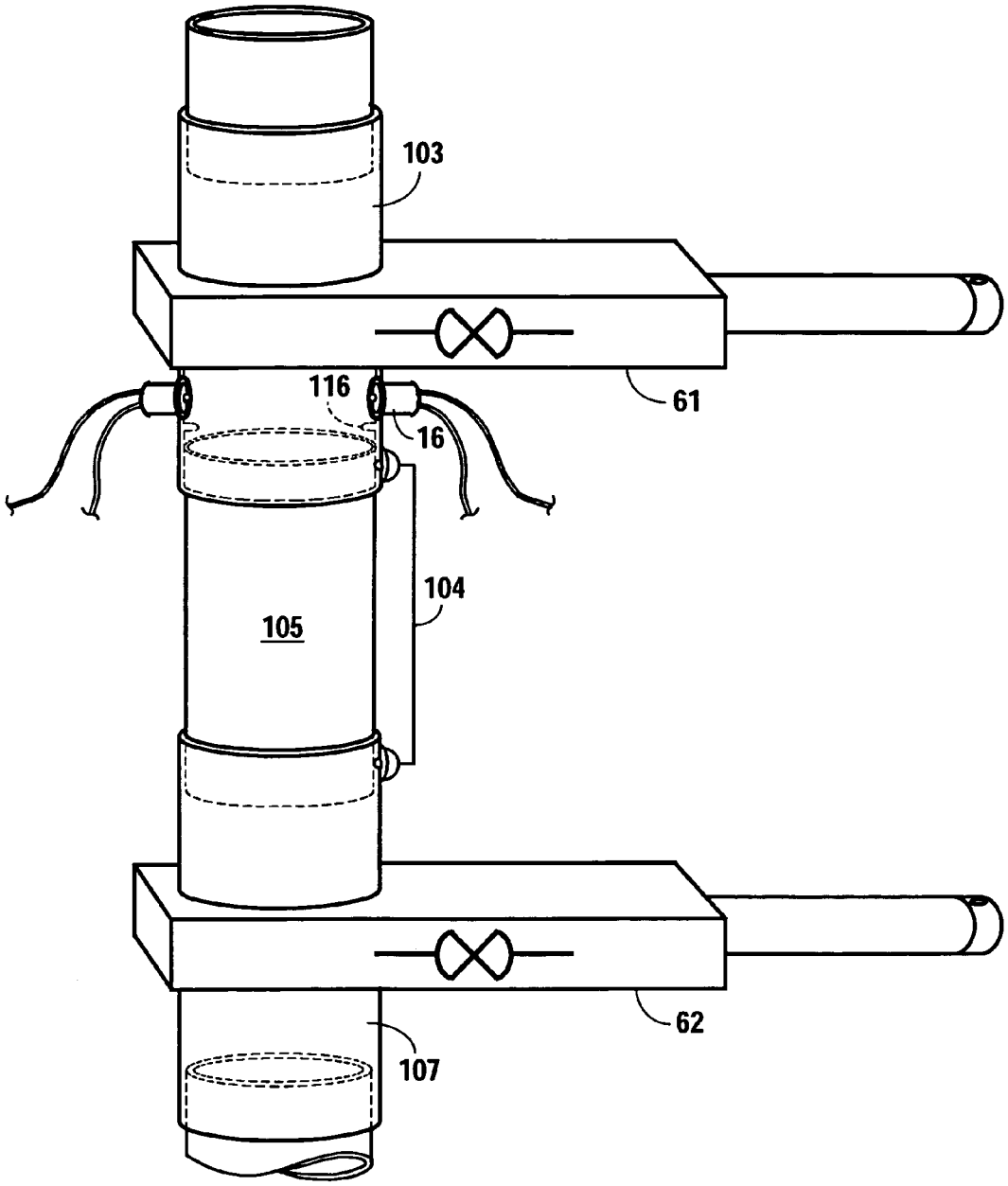
FIG. 1B is a schematic view illustrating a volumetric feeder according to a preferred embodiment.

As illustrated in FIG. 1B, the volumetric feeders 60 and 60A each include an inlet ice transport conduit 103, a volumetric chamber 105, and an outlet ice transport conduit 107. The inlet ice transport conduit 103 connects at an inlet end with one of the outlets from the ice conduit systems 30 and 30A and at an outlet end with an inlet of the volumetric chamber 105. In the preferred embodiment, a set screw secures the volumetric chamber 105 with the inlet ice transport conduit 103. The inlet ice transport conduit 103 includes a gate valve 61 which may be pneumatically, electronically, or manually activated. The gate valve 61 controls the delivery of ice into the volumetric feeders 60A and 60A. The inlet ice transport conduit 103 further includes a sensor 16, preferably an optic sensor, such as photo-emitter and detector pair, which determines the level of ice within the volumetric feeders 60 and 60A. The inlet ice transport conduit 103 still further includes a stop 116 that prevent the over insertion of the volumetric chamber 105 into the inlet ice transport conduit 103.

The outlet ice transport conduit 107 connects at an inlet end with an outlet of the volumetric chamber 105 and at an outlet end with an ice output system. The outlet ice transport conduit 103 includes a gate valve 62 which may be pneumatically, electronically, or manually activated. The gate valve 62 controls the delivery of ice from the volumetric feeders 60 and 60A. In the preferred embodiment, a set screw secures the volumetric chamber 105 with the outlet ice transport conduit 103. Moreover, the set screw allows the location of the gate valve 62 to be adjusted relative to the outlet of the volumetric chamber 105 such that the volume of ice held within the volumetric chamber 105 is adjustable over a preset volume range. In the preferred embodiment, the preset volume range of ice is from 1 to 6 pounds. While the preferred embodiment discloses a preset volume range of ice from 1 to 6 pounds, those skilled in the art will recognize that the lengths of the volumetric chamber 105 and the outlet ice transport conduit 103 may be changed to produce any desired preset volume range. Moreover, those skilled in the art will recognize that multiple optic sensors may be placed in the volumetric chamber 105 in order to electronically provide preset volume ranges.

The volumetric feeders 60 and 60A are volume adjustable to permit the connection of the ice supply system 1 with a range of ice output systems. Illustratively, an ice output system may require the delivery of either 8 pounds or 20 pounds of ice. As such, the volumetric chamber 105 would be set to hold 4 pounds whereupon an 8 pound delivery would be accomplished by filling and dumping the volumetric feeder 60 or 60A twice and a 20 pound delivery would be accomplished by filling and dumping the volumetric feeder 60 or 60A five times. Likewise, 6, 9, and 12 pound deliveries would be accomplished by setting the volumetric chamber 105 to hold 3 pounds whereupon the volumetric feeder 60 or 60A would be filled and dumped two, three, or four times depending upon the desired delivery.

Referring again to FIG. 1A, the preferred embodiment discloses the volumetric feeder 60 connects with an automatic ice bagging unit 50, while the volumetric feeder 60A connects with a consumer bin delivery system 9. While the ice supply system 1 will be described herein with reference to the automatic ice bagging unit 50 and the consumer bin delivery system 9, those of ordinary skill in the art will recognize that the ice supply system 1 is capable of delivering ice into any suitable ice output system and further that the present invention is not to be limited in any respect by the following description.

The volumetric feeder 60 of the ice supply system 1 connects with an automatic ice bagging unit 50 for the purpose of providing individual bags of ice to consumers. Although those skilled in the art will recognize other suitable means for packaging ice for consumption, the automatic ice bagger unit 50 contemplated for use with the ice supply system 1 is any automatic ice bagger unit capable of receiving a supply of ice, automatically placing the ice in a bag, and then sealing the bag for delivery into a merchandiser 51.

An example of an automatic ice bagging unit suitable for use with the ice supply system 1 is an automatic ice bagging unit manufactured by Aqua Polar Corporation, whose business address is 954 North Batavia Street, Orange, Calif. 92867. The Aqua Polar Corporation automatic ice bagging unit opens a bag and suspends the bag in an open position over a merchandiser where ice may be fed into the bag from an ice supply. Once the bag is filled, the bag is sealed and then delivered into the merchandiser. In this preferred embodiment, the outlet ice transport conduit 103 of the volumetric feeder 60 extends into the automatic ice bagging unit directly over the location where an opened bag resides. The ice supply system 1 accordingly delivers ice into the opened bag which is then sealed and delivered into the merchandiser as will be more fully described herein.

Another example of an automatic ice bagging unit that could be rendered suitable to receive a supply of ice, automatically place the ice in a bag, and then seal the bag for delivery into a merchandiser is disclosed in U.S. Pat. Nos. 5,458,851 and 5,630,310, entitled "Automatic Ice Bagger with Self-Contained Sanitizing System" and U.S. Pat. No. 5,581,982, entitled "Method for Automatically Bagging Ice Using a Timer and Multipositional Electronic Scale, all of which are assigned to Packaged Ice, Inc. of Houston, Tex., incorporated herein by reference. The automatic ice bagging unit disclosed in U.S. Pat. Nos. 5,458,851; 5,630,310; and 5,581,982 includes a hopper that holds ice prior to bagging wherein the hopper delivers the ice into an opened bag with an electronic scale utilized to determine the amount of ice delivered into the opened bag. Once the electronic scale determines the appropriate amount of ice has been delivered into the opened bag, the bag is sealed and delivered into a merchandiser. In this preferred embodiment, the hopper and electronic scale are removed and the outlet ice transport conduit 103 of the volumetric feeder 60 extends into the automatic ice bagging unit directly over the location where an opened bag resides. The ice supply system 1 accordingly delivers ice into the opened bag which is then sealed and delivered into the merchandiser as will be more fully described herein.

A consumer bin delivery system 9 suitable for connection with the volumetric feeder 60A of the ice supply system 1 delivers ice directly into a hand carried ice chest 8 such as those manufactured by Igloo and Coleman Corporations. The consumer bin delivery system 9 includes a cabinet with an opening into which a hand carried ice chest 8 is inserted. In this preferred embodiment, the outlet ice transport conduit 103 of the volumetric feeder 60A extends into the cabinet directly over the location where an inserted hand carried ice chest 8 resides. Responsive to a customer request for ice delivery into the hand carried ice chest 8, the ice supply system 1 delivers ice into the inserted hand carried ice chest 8 as will be more fully described herein. While hand carried ice chests are most common for storing and transporting ice, those of ordinary skill in the art will recognize that many other styles of containers or bags may be used to receive ice from the consumer bin delivery system 9.

In order to interface with an ice output system and deliver ice thereto, the ice supply system 1 according to this preferred embodiment includes an ice delivery controller 11 that implements an operational routine for operating the ice supply system 1. Although those of ordinary skill in the art will recognize many suitable means for executing an operational routine for the ice supply system 1, the ice delivery controller 11 according to this preferred embodiment comprises a standard microcontroller widely known in the industry.

The ice delivery controller 11 in the example of this preferred embodiment is electrically connected with the ice supply system 1 and the components thereof, and, in particular, with an ice maker sensory unit 12. In this preferred embodiment, the ice maker sensory unit 12 comprises an optic sensor, such as photo-emitter and detector pair, which determines the level of ice within the dispenser ice bin 27 and outputs a signal to the ice delivery controller 11. Responsive to a signal from the ice maker sensory unit 12 indicating the ice dispenser bin 27 requires ice, the ice delivery controller 11 activates the icemaker 26. Likewise, responsive to a signal from the ice maker sensory unit 12 indicating the ice dispenser bin 27 holds a desired amount of ice, the ice delivery controller 11 deactivates the icemaker 26.

Continuing the example of this preferred embodiment, the ice delivery controller 11 is electrically connected with the sensors 16 of the volumetric feeders 60 and 60A, an ice request unit 17 of the automatic ice bagging unit 50, and an ice request unit 17A of the consumer bin delivery system 9. In this preferred embodiment, the ice request units 17 and 17A comprise any suitable means capable of signaling the ice delivery controller 11 to deliver ice respectively to either the automatic ice bagging unit 50 or the consumer bin delivery system 9. An example of the ice request unit 17 includes but is not limited to the following. The ice request unit 17 may include an optic sensor, such as photo-emitter and detector pair, disposed in the merchandiser 51 that determines when the number of ice bags within the merchandiser 51 is below a desired number and must be replenished. Responsive to a signal from the ice request unit 17 indicating the merchandiser 51 requires more ice bags, the ice delivery controller 11 activates the automatic ice bagging unit 50 and the ice supply system 1 to deliver ice thereto until the ice request unit 17 outputs a signal indicating the merchandiser 51 includes a desired number of ice bags. The ice request unit 17 also may include a user input such as a keypad that allows a customer to request a specific size ice bag. Responsive to a signal from the ice request unit 17 indicating a specific size ice bag has been requested, the ice delivery controller 11 activates the automatic ice bagging unit 50 and the ice supply system 1 to deliver ice thereto until the ice bag has been filled and delivered for the customer into the merchandiser 51.

An example of the ice request sensor unit 17A includes but is not limited to the following. The ice request unit 17A may include a user input having a payment mechanism, such as a bill and change reader or credit card scanner, and an optic sensor, such as photo-emitter and detector pair, disposed in the cabinet and positioned to determine when an inserted hand carried ice chest 8 is full. A customer inserts a hand carried ice chest 8 followed by the depositing of payment. Responsive to a signal from the ice request unit 17A indicating payment has been made, the ice delivery controller 11 activates the ice supply system 1 which delivers ice into the inserted hand carried ice chest 8 until the ice request unit 17 outputs a signal indicating the inserted hand carried ice chest 8 holds a desired amount of ice. The user input also may allow the consumer to request a specific amount of ice. Responsive to a signal from the ice request unit 17A indicating payment has been made along with a request for a specific amount of ice, the ice delivery controller 11 activates the ice supply system 1 which delivers ice into the inserted hand carried ice chest 8 until the requested amount of ice has been delivered to the inserted hand carried ice chest 8.

It should be understood that the ice delivery controller 11 may comprise a stand-alone unit for integration and engagement with the ice supply system 1. The ice delivery controller 11 may comprise a master controller that operates the components of the ice supply system 1 as well as any connected ice output system in place of control systems for the connected ice output systems. Alternatively, the ice delivery controller 11 may be a separate "add-on" unit linked and in engagement with each component of the ice supply system 1, such as controllers for the volumetric feeders 60 and 60A, a controller for the ice transport system 20, as well as the controllers for the automatic ice bagging unit 50 and the consumer bin delivery system 9, which operate independently in response to signals from the ice delivery controller 11.

In order to set forth the present invention and provide an understanding thereof, FIGS. 2-5 illustrate an example routine for operating the ice supply system 1 of FIG. 1. Inasmuch, although those of ordinary skill in the art will recognize the application of the ice supply system 1 in a variety of commercial and private settings, FIG. 1 illustratively depicts the ice supply system 1 in operative engagement with a convenience store 5. In FIG. 1 the ice delivery controller 11 and the ice transport system 20 are located in a back room of the convenience store 5 away from the customer. The volumetric feeder 60 and the automatic ice bagger system 50 is located inside the convenience store 5 while the volumetric feeder 60 and the consumer bin delivery system 9 is located outside the convenience store 5 for hand held bags or ice chests.

Figure 2:
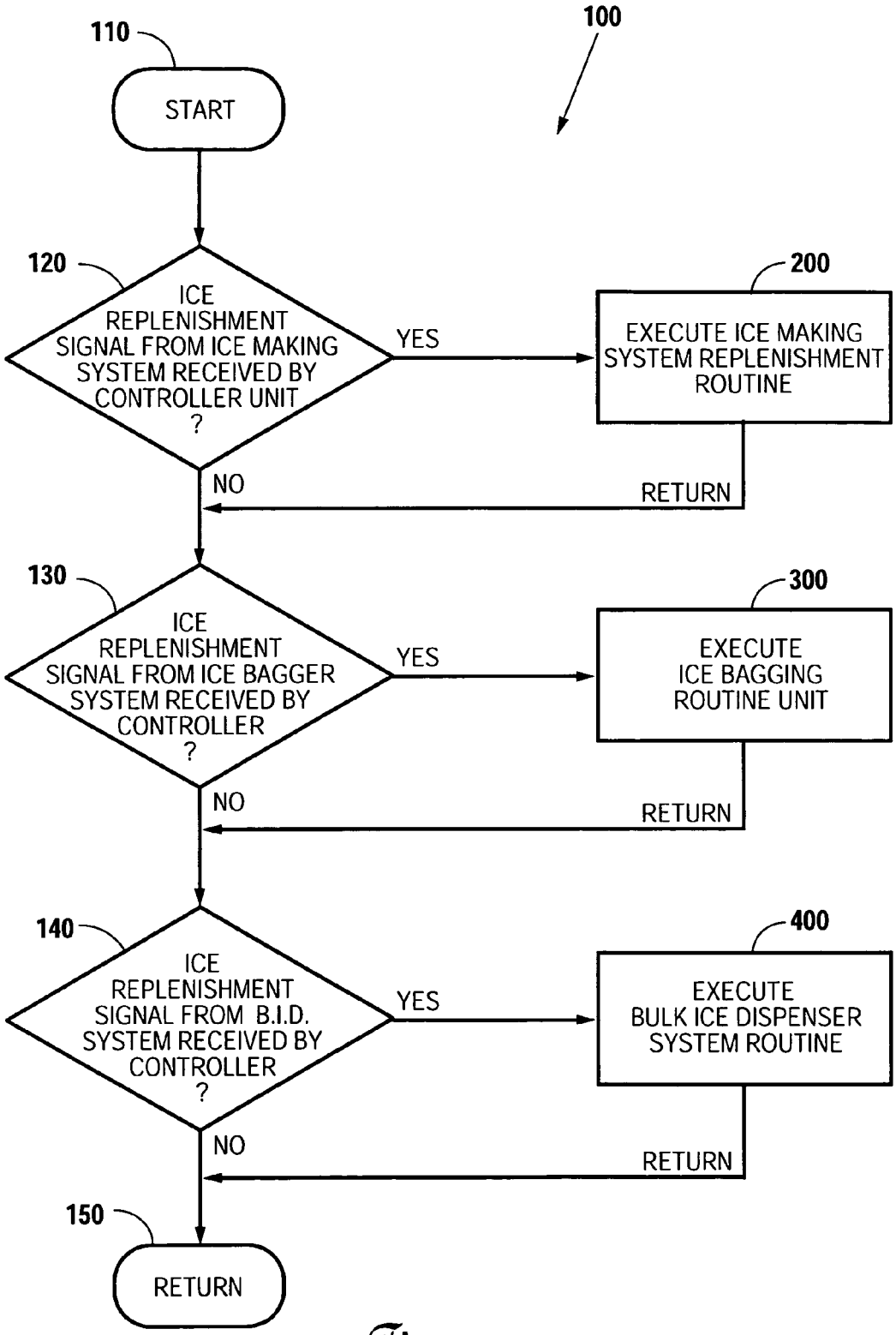
FIG. 2 is a flow diagram illustrating a main routine for operating the ice supply system.

FIG. 2 is a flow diagram that schematically illustrates a main routine 100 for operating the ice supply system 1. Step 110 starts the main routine 100. In step 120, the ice delivery controller 11 awaits a signal from the ice maker sensory unit 12 indicating the ice dispenser bin 27 requires ice. If the ice dispenser bin 27 requires ice and no signal is output from the ice maker sensory unit 12, the ice delivery controller 11 progresses to step 130. However, upon receipt of a signal from the ice maker sensory unit 12, the ice delivery controller 11 begins an ice transport system replenishment routine 200 and then advances to step 130.

In a similar manner, the ice delivery controller 11 in step 130 awaits a signal from the ice request unit 17 indicating the merchandiser 51 of the automatic bagging unit 50 requires an ice bag or bags. If the merchandiser 51 does not require an ice bag or bags, the ice delivery controller 11 progresses to step 140. However, upon receipt of a signal from the request unit 17, the ice delivery controller 11 begins an ice bagging unit replenishment routine 300 and then advances to step 140.

Likewise, the ice delivery controller 11 in step 140 awaits a signal from the ice request unit 17A indicating a request for ice has been made along with payment. If no request from the ice request unit 17A has been made, the ice delivery controller 11 progresses to step 150. However, upon receipt of a signal from the request unit 17A, the ice delivery controller 11 begins a bulk ice dispenser system routine 400 and then advances to step 150. In step 150 the ice delivery controller 11 returns to step 110 and restarts the main routine 100. It should be understood that the ice delivery controller 11 continuously monitors the ice dispenser bin 27, the automatic bagging unit 50, and the consumer bin delivery system 9 such that the ice transport system replenishment routine 200, the ice bagging unit replenishment routine 300, and the bulk ice dispenser system routine 400 may be executed separately by the ice delivery controller 11.

Figure 3:
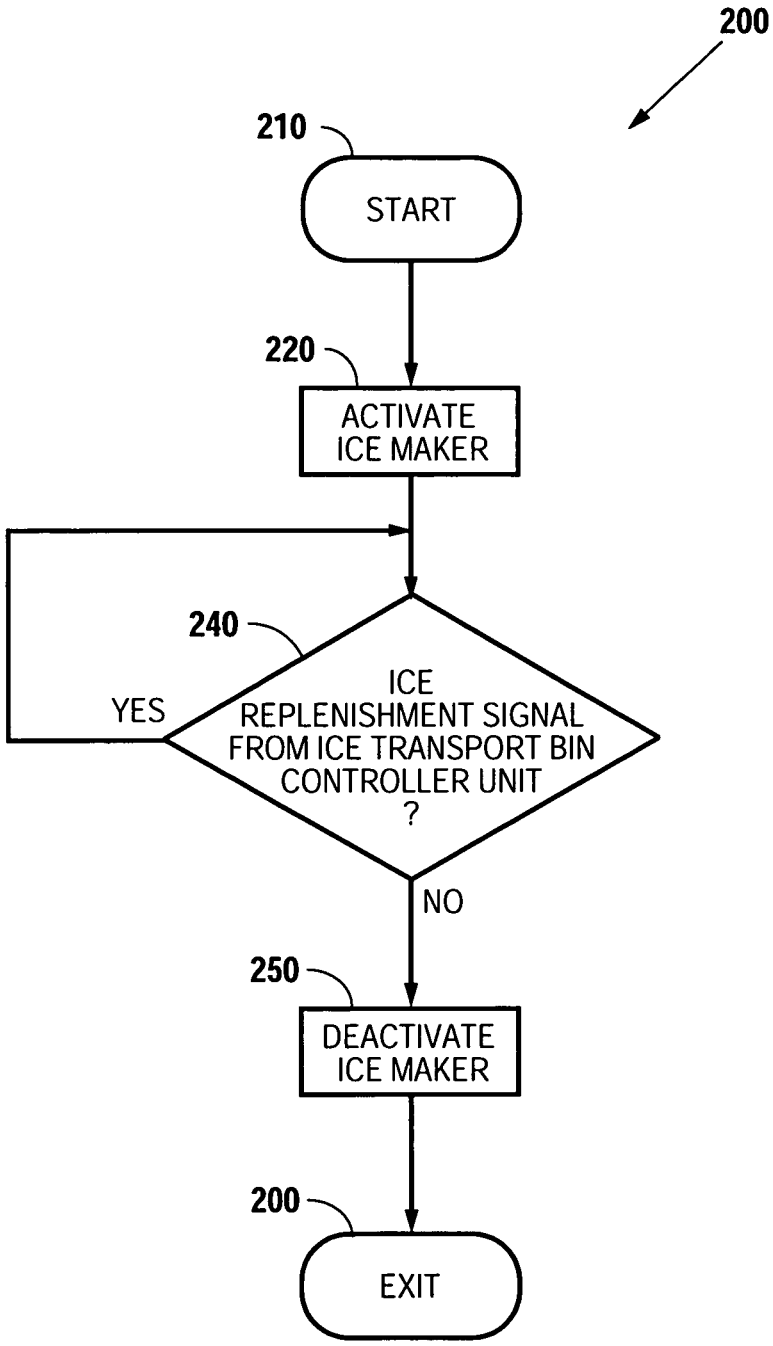
FIG. 3 a flow diagram illustrating an ice transport system replenishment routine for providing a supply of ice to an ice dispenser bin of the ice supply system.

FIG. 3 is a flow diagram that schematically illustrates the ice transport system replenishment routine 200 for providing a supply of ice to the ice dispenser bin 27 of the ice supply system 1. Step 210 starts the ice transport system replenishment routine 200. The ice delivery controller 11 in step 220 outputs a signal to activate the icemaker 26 before proceeding to step 240. In step 240, the ice delivery controller 11 awaits a signal from the ice maker sensory unit 12 indicating that the dispenser ice bin 27 contains a desired amount of ice. As long as the ice maker sensory unit 12 outputs a signal indicating the ice dispenser bin 27 requires ice, the ice delivery controller 11 maintains the icemaker 26 activated. If, however, the ice maker sensory unit 12 outputs a signal indicating the ice dispenser bin 27 contains a desired amount of ice, the ice delivery controller 11 progresses to step 250 and deactivates the ice maker 26. The ice delivery controller 11 then exits the ice transport system replenishment routine 200 at step 260.

Figure 4:
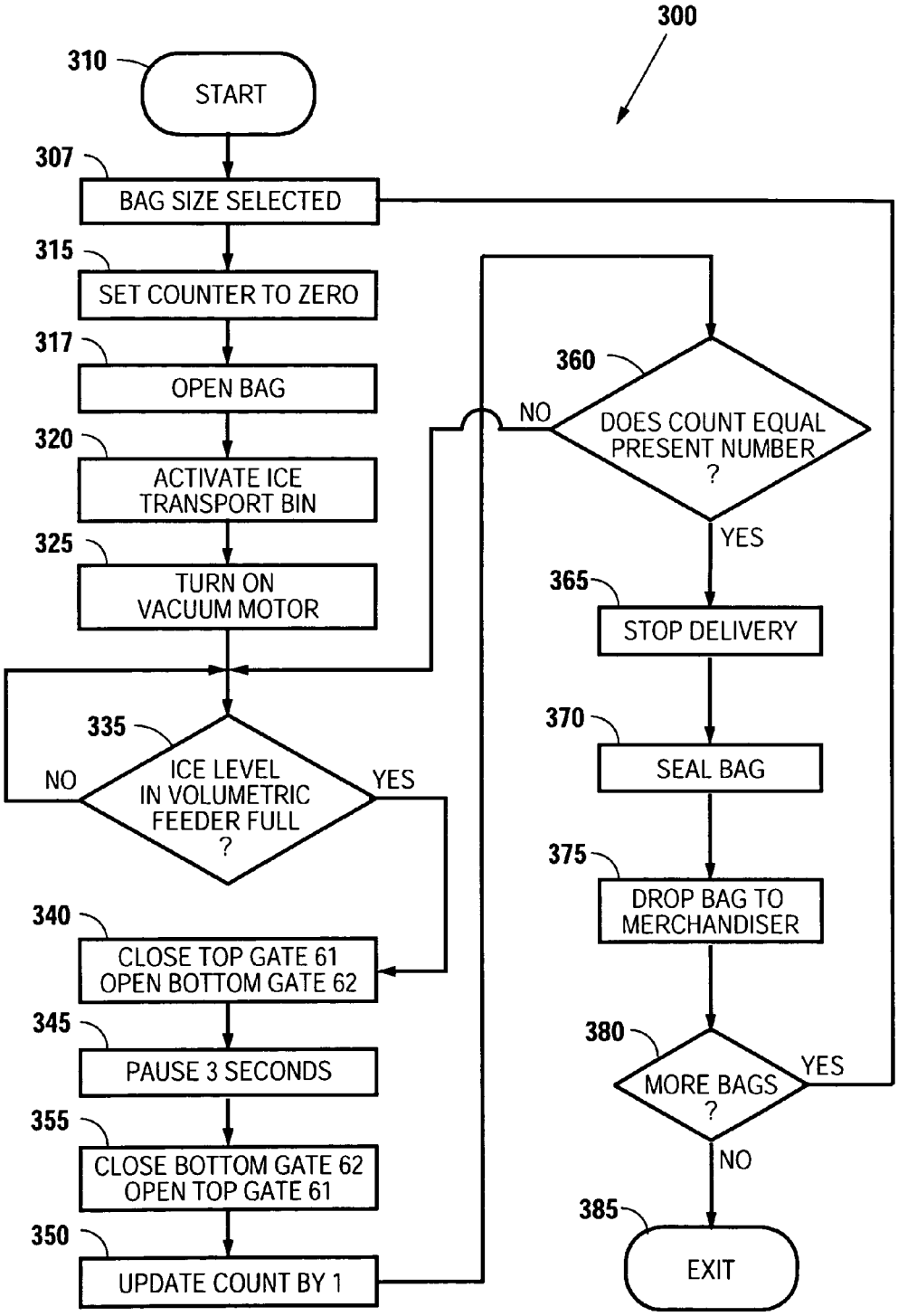
FIG. 4 is a flow diagram illustrating an automatic bagging unit replenishment routine for providing a supply of ice to an automatic bagging unit.

FIG. 4 is a flow diagram that schematically illustrates the automatic bagging unit replenishment routine 300 for providing a supply of ice to the automatic bagging unit 50. Before the ice supply system 1 and the automatic bagging unit 50 may be employed to deliver ice bags, the ice supply system 1 and the automatic bagging unit 50 must be installed and initialized for operation. This involves correlating the ice supply system 1 with the automatic bagging unit 50. For the sake of example and to more fully explain the present invention, the automatic bagging unit 50 in the example illustrated with respect to FIG. 4 is a unit capable of supplying either 8 pound ice bags or 20 pound ice bags. When filling the merchandiser 51 with ice bags, the automatic ice bagging unit 50 will alternately produce 8 pound ice bags and 20 pound ice bags; although the frequency and number of ice bags may be set at any number depending upon customer demand. The automatic bagging unit 50 is also capable of producing single 8 pound ice bags or 20 pound ice bags responsive to a customer request in the event a desired bag size is not available in the merchandiser 51. While the example set forth in FIG. 4 provides for two different ice bag sizes, those of ordinary skill in the art will recognize that one bag size or multiple bag sizes are within the scope of the present invention.

Correlating the ice supply system 1 with the automatic bagging unit 50 involves adjusting the positional relationship between the gate valve 62 and the outlet of the volumetric chamber 105 such that the volume of ice held within the volumetric chamber 105 is set to a desired volume corresponding to a desired amount of ice. The desired volume in the example of FIG. 4 is 4 pounds. The set screw securing the volumetric chamber 105 with the outlet ice transport conduit 103 is released and the outlet ice transport conduit 103 is moved until the gate valve 62 resides at a location that produces 4 pounds of ice within the volumetric chamber 105. The set screw is then tightened to maintain the connection between the volumetric chamber 105 and the outlet ice transport conduit 103. The volumetric chamber 105 may be preset during the production of the volumetric feeder 60 with marks thereon that indicate differing amounts of ice. Alternatively, the output from the volumetric chamber 105 may be set on site using adjustments effected by weighing ice dumps until the desired amount is determined.

Correlating the ice supply system 1 with the automatic bagging unit 50 further involves supplying the ice delivery controller 11 with an automatic bagging unit replenishment routine 300 that controls the volumetric feeder 60 to deliver a desired amount of ice into an ice bag. In the example of FIG. 4, the ice delivery controller 11 fills and dumps the volumetric feeder 60 twice to produce an 8 pound ice bag, whereas the ice delivery controller fills and dumps the volumetric feeder 60 five to produce a 20 pound ice bag. The ice delivery controller 11 may be programmed with the correct automatic bagging unit replenishment routine 300 during the production the ice delivery controller 11. Alternatively, the correct automatic bagging unit replenishment routine 300 may be downloaded into the ice delivery controller 11 on site or over communication lines through a suitable input device included in the ice delivery controller 11.

Step 310 starts the automatic bagging replenishment routine 300 for the ice supply system 1. In step 307, the ice delivery controller 11 determines from the signal output by the ice request unit 17 whether an 8 pound ice bag or a 20 pound ice bag is required. In the example of FIG. 4, an initial output from the ice request unit 17 that the merchandiser 51 requires an ice bag or bags indicates that an 8 pound ice bag will be produced first followed by a 20 pound ice bag if necessary. It should be understood that the order and frequency of ice bag production may be varied as desired based upon customer demand. Alternatively, the signal output from the ice request unit 17 may entail a customer request for a specific size ice bag. From that request, the ice delivery controller 11 recognizes whether an 8 pound ice bag or a 20 pound ice bag should be produced.

After determining the ice bag for production, the ice delivery controller 11 proceeds to step 315 and sets an ice delivery counter to 0. The ice delivery counter is utilized by the ice delivery controller in controlling the volumetric feeder 60 to deliver the correct number of ice batches to the automatic ice bagging unit 50. In the example of FIG. 4, the ice delivery counter is 2 for an 8 pound ice bag and 5 for a 20 pound ice bag. The ice delivery controller 11 next proceeds to step 317 and directs the automatic ice bagging unit 50 to open a bag. Responsive thereto, the automatic ice bagging unit 50 opens a bag from a correct bag holder, either an 8 pound bag or a 20 pound bag depending upon the desired bag size. Alternatively, the automatic ice bagger unit 50 may include a roll of plastic suitable for formation into bags and the ability to form a desired bag size. In the embodiment where the ice delivery controller 11 is an "add on", a controller of the automatic ice bagging unit 50 performs the task of opening a bag.

Once the bag is opened, the ice delivery controller 11 in step 320 activates a delivery device in the ice dispenser bin 27 thereby beginning the delivery of ice to the ice conduit system 30. The ice delivery controller 11 activates the vacuum pump 38 in step 325 to create via the vacuum line 32 a negative pressure within the ice conduit system 30 resulting in ice traveling from dispenser ice bin 27 to the volumetric feeder 60. In this preferred embodiment, the gate valve 61 is set in an open position while the gate valve 62 is set in a closed position such that ice enters the volumetric feeder 60 and accumulates in the volumetric chamber 105. In step 335, the ice delivery controller 11 monitors the sensor 16 of the volumetric feeder 60, awaiting a signal from the sensor 16 indicating the volumetric feeder 60 is full. As long as the sensor 16 indicates the volumetric feeder 60 is not full, the gate valve 61 remains open and ice accumulates within the volumetric chamber 105. As soon as the sensor 16 registers the volumetric feeder 60 is full and outputs a signal indicative thereof, the ice delivery controller 11 proceeds to step 340 and closes the gate valve 61 while opening the gate valve 62. In this preferred embodiment, the ice delivery controller 11 pauses 3 seconds in step 345 before proceeding to step 350. The ice delivery controller 11 in step 350 closes the gate valve 62 while opening the gate valve 61 prior to proceeding to step 355 where the ice delivery controller 11 updates the ice delivery counter by 1.

Upon exiting step 355, the ice delivery controller 11 proceeds to step 360 and determines the value of the ice delivery counter. If the ice delivery counter does not equal the full count value for the ice bag being filled, the ice delivery controller 11 returns to step 335 for a repeat of steps 335, 340, 345, 350, and 355 wherein a load of ice from the volumetric feeder 60 is delivered into the open bag. If the ice delivery counter equals the full count value for the ice bag being filled, the ice delivery controller 11 proceeds to step 365. In the example of FIG. 4, a full count value for an 8 pound ice of ice is 2 and a full count value for a 20 pound ice bag is 5. Consequently, the ice delivery controller 11 will perform steps 335, 340, 345, 350, and 355 either twice or five times.

The ice delivery controller 11 in step 365 stops the delivery of ice to the volumetric feeder 60 by deactivating the delivery device in the ice dispenser bin 27 and the vacuum pump 38. The ice delivery controller 11 then proceeds to step 370 and directs the automatic ice bagging unit 50 to seal the filled ice bag. The ice delivery controller 11 further proceeds to step 375 and directs the automatic ice bagging unit 50 to drop the filled ice bag into the merchandiser 51. In the embodiment where the ice delivery controller 11 is an "add on", a controller of the automatic ice bagging unit 50 performs the tasks of sealing and dropping the filled ice bag.

After the filled ice bag has been dropped into the merchandiser 51, the ice delivery controller 11 proceeds to step 380 and determines if more ice bags are to be produced. In the scenario where the merchandiser 51 is being replenished with ice bags, the ice request unit 17 outputs a signal indicating replenishment is needed until the merchandiser 51 is full. As such, the ice delivery controller 11 returns to step 307 and determines from the signal output by the ice request unit 17 whether an 8 pound ice bag or a 20 pound ice bag is required prior to delivering such and ice bag into the merchandiser.

Once the ice request unit 17 outputs a signal indicating the merchandiser 51 is full, the ice delivery controller 11 exits the automatic bagging replenishment routine 300 at step 385. In the scenario where a customer request for a specific size ice bag was being satisfied, the ice delivery controller 11 recognizes completion of the request and exits the automatic bagging replenishment routine 300 at step 385.

Figure 5:
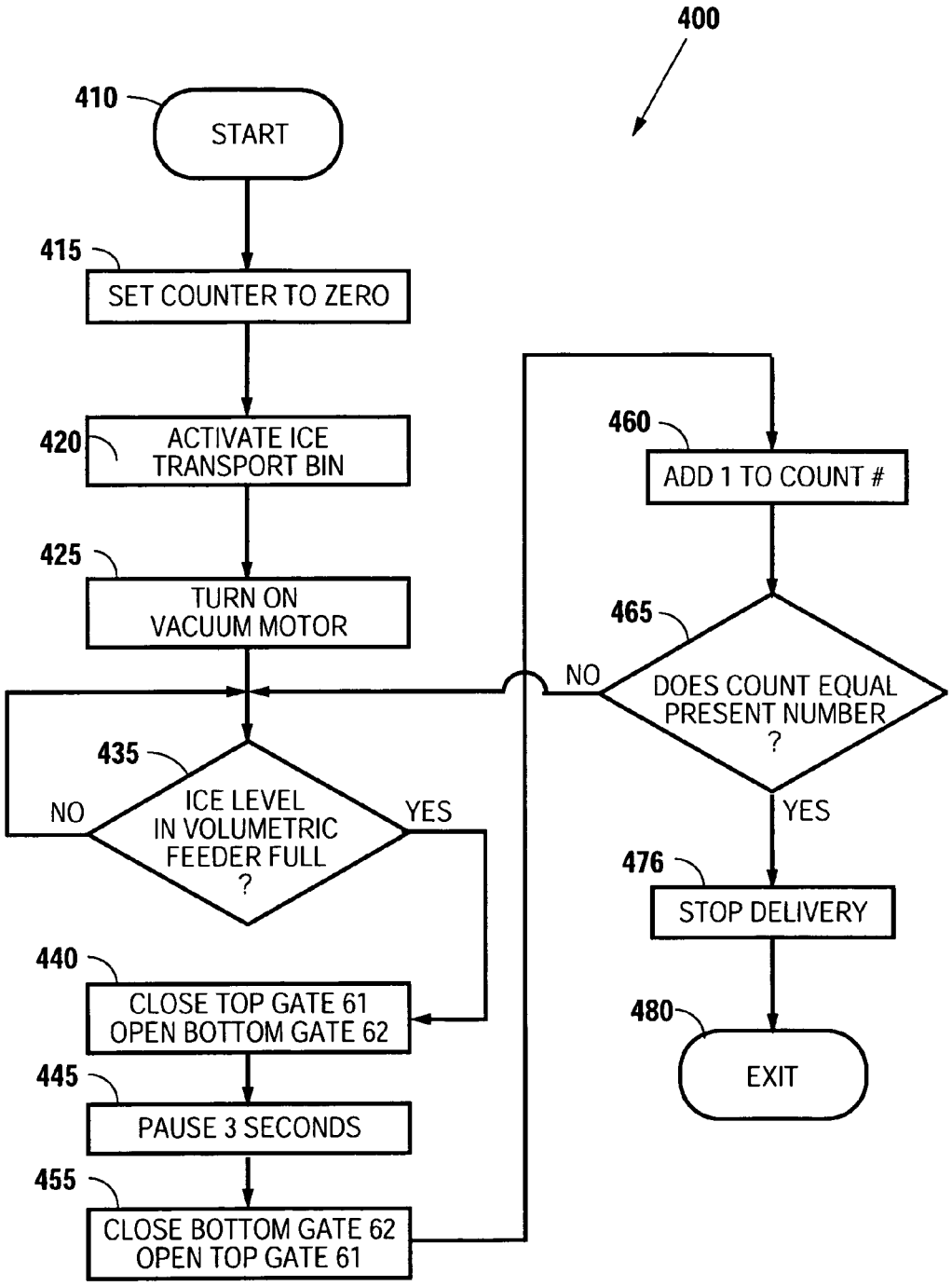
FIG. 5 is a flow diagram illustrating a bulk ice dispenser system routine for providing a supply of ice to a consumer bin delivery system.

FIG. 5 is a flow diagram that schematically illustrates the bulk ice dispenser system routine 400 for providing a supply of ice to the consumer bin delivery system 9. Before the ice supply system 1 and the consumer bin delivery system 9 may be employed to deliver ice to a hand carried ice chest 8 inserted into the consumer bin delivery system 9, the ice supply system 1 and the consumer bin delivery system 9 must be installed and initialized for operation. This involves correlating the ice supply system 1 with the consumer bin delivery system 9. For the sake of example and to more fully explain the present invention, the ice supply system 1 and the consumer bin delivery system 9 in the example illustrated with respect to FIG. 5 will supply ice to a hand carried ice chest 8 in 3 pound increments up to a total of 15 pounds.

Correlating the ice supply system 1 with the consumer bin delivery system 9 involves adjusting the positional relationship between the gate valve 62 and the outlet of the volumetric chamber 105 such that the volume of ice held within the volumetric chamber 105 of the volumetric feeder 60A is 3 pounds. The set screw securing the volumetric chamber 105 with the outlet ice transport conduit 103 is released and the outlet ice transport conduit 103 is moved until the gate valve 62 resides at a location that produces 3 pounds of ice within the volumetric chamber 105. The set screw is then tightened to maintain the connection between the volumetric chamber 105 and the outlet ice transport conduit 103. The volumetric chamber 105 may be preset during the production of the volumetric feeder 60A with marks thereon that indicate differing amounts of ice. Alternatively, the output from the volumetric chamber 105 may be set on site using adjustments effected by weighing ice dumps until the desired amount is determined.

Correlating the ice supply system 1 with the consumer bin delivery system 9 further involves supplying the ice delivery controller 11 with a bulk ice dispenser system routine 400 that controls the volumetric feeder 60A to deliver a desired amount of ice into a hand carried ice chest 8. In the example of FIG. 5, the ice delivery controller 11 fills and dumps the volumetric feeder 60A 1, 2, 3, 4, or 5 times depending upon the selected amount of ice. The ice delivery controller 11 may be programmed with the correct bulk ice dispenser system routine 400 during the production the ice delivery controller 11. Alternatively, the correct bulk ice dispenser system routine 400 may be downloaded into the ice delivery controller 11 on site or over communication lines through a suitable input device included in the ice delivery controller 11.

Operation of the consumer bin delivery system 9 begins with a customer inserting a hand carried ice chest 8 into the consumer bin delivery system 9. The customer further employs the ice request unit 17A to deposit payment and select an amount of ice for delivery into the inserted hand carried ice chest 8. The ice request unit 17A outputs a start signal to the ice delivery controller 11 as well as a signal indicating the selected amount of ice for delivery into the inserted hand carried ice chest 8. Responsive to the signals from the ice request unit 17A, the ice delivery controller 11 in step 410 starts the bulk ice dispenser system routine 400 for the ice supply system 1. The ice delivery controller 11 proceeds to step 415 and sets an ice delivery counter to 0. The ice delivery counter is utilized by the ice delivery controller in controlling the volumetric feeder 60A to deliver the correct number of ice batches to the automatic ice bagging unit 50. In the example of FIG. 5, the ice delivery counter is 1, 2, 3, 5, or 5 depending upon the amount of ice selected by the customer.

Once the ice delivery counter is reset to 0, the ice delivery controller 11 in step 420 activates a delivery device in the ice dispenser bin 27 thereby beginning the delivery of ice to the ice conduit system 30A. The ice delivery controller 11 activates the vacuum pump 38 in step 425 to create via the vacuum line 32A a negative pressure within the ice conduit system 30A resulting in ice traveling from dispenser ice bin 27 to the volumetric feeder 60A. In this preferred embodiment, the gate valve 61 is set in an open position while the gate valve 62 is set in a closed position such that ice enters the volumetric feeder 60A and accumulates in the volumetric chamber 105. In step 435, the ice delivery controller 11 monitors the sensor 16 of the volumetric feeder 60A, awaiting a signal from the sensor 16 indicating the volumetric feeder 60A is full. As long as the sensor 16 indicates the volumetric feeder 60A is not full, the gate valve 61 remains open and ice accumulates within the volumetric chamber 105. As soon as the sensor 16 registers the volumetric feeder 60 is full and outputs a signal indicative thereof, the ice delivery controller 11 proceeds to step 440 and closes the gate valve 61 while opening the gate valve 62. In this preferred embodiment, the ice delivery controller 11 pauses 3 seconds in step 445 before proceeding to step 455. The ice delivery controller 11 in step 455 closes the gate valve 62 while opening the gate valve 61 prior to proceeding to step 460 where the ice delivery controller 11 updates the ice delivery counter by 1.

Upon exiting step 460, the ice delivery controller 11 proceeds to step 465 and determines the value of the ice delivery counter. If the ice delivery counter does not equal the full count value for the amount of ice being delivered into the inserted hand carried ice chest 8, the ice delivery controller 11 returns to step 435 for a repeat of steps 435, 440, 445, 455, and 460 wherein a load of ice from the volumetric feeder 60A is delivered into the inserted hand carried ice chest 8. If the ice delivery counter equals the full count value for the amount of ice being delivered into the inserted hand carried ice chest 8, the ice delivery controller 11 proceeds to step 476. In the example of FIG. 5, a full count value will be 1, 2, 3, 4, or 5 depending upon the amount of ice selected for delivery.

The ice delivery controller 11 in step 476 stops the delivery of ice to the volumetric feeder 60A by deactivating the delivery device in the ice dispenser bin 27 and the vacuum pump 38. The ice delivery controller 11 then exits the bulk ice dispenser system routine 400 at step 480.

In the scenario where the ice request unit 17A measures the amount of ice within an inserted hand carried ice chest 8, steps 415 and 460 are unnecessary and step 465 is changed to a decision step based on an output signal received from the ice request unit 17A. In particular, the ice delivery controller 11 in a revised step 465 awaits a signal from the ice request unit 17A indicating the amount of ice with an inserted hand carried ice chest 8. If the signal output from the ice request unit 17A to the ice delivery controller 11 indicates the inserted hand carried ice chest 8 is not full, the ice delivery controller 11 returns to step 435 for a repeat of steps 435, 440, 445, and 455, wherein a load of ice from the volumetric feeder 60A is delivered into the inserted hand carried ice chest 8. Alternatively, if the signal output from the ice request unit 17A to the ice delivery controller 11 indicates the inserted hand carried ice chest 8 is full, the ice delivery controller 11 would proceed to step 476 and then to step 480.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

The invention claimed is:

1. An ice supply system, comprising:

an ice transport system;

a volumetric feeder coupled with the ice transport system and adapted to receive a preset volume of ice therein and to deliver the preset volume of ice to an ice output system, the volumetric feeder, comprising:

an inlet ice transport conduit including an inlet coupled with the ice transport system and an outlet, an inlet gate valve disposed in the inlet ice transport conduit, a volumetric chamber including an inlet coupled with the outlet of the inlet ice transport conduit and an outlet, an outlet ice transport conduit including an inlet coupled with the outlet of the volumetric chamber and an outlet coupled with the ice output system, an outlet gate valve disposed in the outlet ice transport conduit, and a sensor disposed in the inlet ice transport conduit, wherein the sensor measures the volume of ice in the volumetric feeder and outputs a signal indicating when the volumetric feeder has received the preset volume of ice therein; and an ice delivery controller coupled with the ice transport system, the volumetric feeder, and the ice output system, wherein the ice delivery controller:

receives ice requests from the ice output system, controls the delivery of ice from the ice transport system to the volumetric feeder in response to ice requests, closes the outlet gate valve and opens the inlet gate valve in response to ice requests such that the volumetric chamber receives the preset volume of ice therein, and closes the inlet gate valve and opens the outlet gate valve once the sensor outputs a signal indicating the volumetric chamber has received the preset volume of ice therein such that the volumetric chamber delivers to the ice output system.

2. The ice supply system according to claim 1, wherein the ice delivery controller determines from an ice request a delivery number which is the number of times the volumetric feeder must deliver the preset volume of ice to the ice output system in order to fill the ice request.

3. The ice supply system according to claim 2, wherein the ice delivery controller controls the volumetric feeder to receive and deliver the preset volume of ice to the ice output system until the delivery number has been reached.

4. The ice supply system according to claim 3, wherein the ice delivery controller activates the ice transport system to deliver ice to the volumetric feeder upon receipt of an ice request and deactivates the ice transport system once the delivery number has been reached.

5. The ice supply system according to claim 2, wherein the ice delivery controller sequentially opens and closes the inlet gate valve of the volumetric feeder and the outlet gate valve of the volumetric feeder to receive and deliver the preset volume of ice to the ice output system until the delivery number has been reached.

6. The ice supply system according to claim 1, wherein the volumetric feeder is adjustable to change the preset volume of ice delivered to the ice output system.

7. The ice supply system according to claim 1, wherein the volumetric feeder further comprises a stop disposed in the inlet ice transport conduit that prevents the over insertion of the volumetric chamber into the inlet ice transport conduit.

8. The ice supply system according to claim 1, wherein the position of the outlet ice transport conduit is adjustable relative to the volumetric chamber such that the preset volume of ice delivered to the ice output system is adjustable.

9. The ice supply system according to claim 1, wherein the ice delivery controller determines from an ice request a delivery number which is the number of times the volumetric feeder must deliver the preset volume of ice to the ice output system in order to fill the ice request.

10. The ice supply system according to claim 9, wherein the ice delivery controller sequentially opens and closes the inlet and outlet gate valves to receive and deliver the preset volume of ice to the ice output system until the delivery number has been reached.

11. The ice supply system according to claim 10, wherein the ice delivery controller activates the ice transport system to deliver ice to the volumetric feeder upon receipt of an ice request and deactivates the ice transport system once the delivery number has been reached.

12. A method of supplying ice to an ice output system, comprising:

providing an ice transport system;

providing a volumetric feeder coupled with the ice transport system and adapted to receive a preset volume of ice therein and to deliver the preset volume of ice to an ice output system;

receiving an ice request from the ice output system;

delivering ice from the ice transport system to the volumetric feeder in response to the ice request;

opening an inlet into the volumetric feeder while closing an outlet from the volumetric feeder;

sensing the volume of ice in the volumetric feeder to determine when the volumetric feeder has received the preset volume of ice therein;

closing the inlet into the volumetric feeder;

opening the outlet from the volumetric feeder, thereby delivering the preset volume of ice from the volumetric feeder to the ice output system; and ceasing the delivery of ice from the ice transport system to the volumetric feeder.

13. The method of supplying ice to an ice output system according to claim 12, wherein providing a volumetric feeder adapted to deliver a preset volume of ice to an ice output system comprises adjusting the volumetric feeder to deliver a desired preset volume of ice delivered to the ice output system.

14. A method of supplying ice to an ice output system, comprising:

providing an ice transport system;

providing a volumetric feeder coupled with the ice transport system and adapted to receive a preset volume of ice therein and to deliver the preset volume of ice to an ice output system;

receiving an ice request from the ice output system;

determining from the ice request a delivery number which is the number of times the volumetric feeder must deliver the preset volume of ice to the ice output system in order to fill the ice request;

delivering ice from the ice transport system to the volumetric feeder in response to the ice request;

sequentially receiving the preset volume of ice in the volumetric feeder and delivering the preset volume of ice from the volumetric feeder to the ice output system until the delivery number has been reached; and ceasing the delivery of ice from the ice transport system to the volumetric feeder once the delivery number has been reached.

15. The method of supplying ice to an ice output system according to claim 14, wherein sequentially receiving the preset volume of ice in the volumetric feeder and delivering the preset volume of ice from the volumetric feeder to the ice output system comprises sequentially opening and closing an inlet into the volumetric feeder and an outlet from the volumetric feeder.

16. The method of supplying ice to an ice output system according to claim 14, wherein providing a volumetric feeder adapted to deliver a preset volume of ice to an ice output system comprises adjusting the volumetric feeder to deliver a desired preset volume of ice delivered to the ice output system.

* * * * *